US008025538B2

(12) United States Patent
Hara et al.

(10) Patent No.: US 8,025,538 B2
(45) Date of Patent: Sep. 27, 2011

(54) JOINT CONNECTOR AND WIRING HARNESS

(75) Inventors: Teruo Hara, Yokkaichi (JP); Yuujirou Imai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/917,572

(22) Filed: Nov. 2, 2010

(65) Prior Publication Data

US 2011/0111639 A1 May 12, 2011

(30) Foreign Application Priority Data

Nov. 10, 2009 (JP) ..... 2009-257012

(51) Int. Cl.
*H01R 11/09* (2006.01)

(52) U.S. Cl. ..... 439/723

(58) Field of Classification Search ..... 439/721–724, 439/595, 34, 92, 97
See application file for complete search history.

(56) References Cited

U.S. PATENT DOCUMENTS

| | | | | |
|---|---|---|---|---|
| 6,149,462 | A * | 11/2000 | Sugie | 439/595 |
| 6,655,994 | B2 * | 12/2003 | Yamamoto | 439/595 |
| 7,661,999 | B2 * | 2/2010 | Horiuchi et al. | 439/752 |
| 2007/0224882 | A1 * | 9/2007 | Yoshikai | 439/595 |

FOREIGN PATENT DOCUMENTS

JP 5-94980 12/1993

* cited by examiner

*Primary Examiner* — Phuong K Dinh
(74) *Attorney, Agent, or Firm* — Gerald E. Hespos; Michael J. Porco

(57) ABSTRACT

A joint connector has a housing (20) and cavities (21) penetrate the housing (20) in forward and backward directions. Female terminals (11) connected to ends of wires (10) are insertable into the cavities (21) from behind and locking lances (22) in the respective cavities (21) retain the female terminals (11). Jig insertion grooves (30) are formed in the front surface of the housing (20) and can receive a jig (80) to displace the locking lance (22) in an unlocking direction. A joint terminal (50) to be mounted in the housing (20) and formed such that a bracket (52) to be mounted on a grounding portion is connected with the rear edge of a male terminal (51) in which male terminals (55) insertable into the respective cavities (21) from front are connected side by side.

8 Claims, 19 Drawing Sheets

JOINT CONNECTOR AND WIRING HARNESS

BACKGROUND OF THE INVENTION

1. Field of the Invention

The invention relates to a ground joint connector and to a wiring harness using this joint connector.

2. Description of the Related Art

Japanese Unexamined Patent Publication No. H05-94980 discloses a compact joint connector used to connect a plurality of ground wires with a grounding portion of a vehicle at once. This ground connector has a housing and a plurality of side by side cavities penetrate the housing in forward and backward directions. Female terminals are insertable into the cavities from behind. A joint terminal has a male terminal portion and a plurality of side by side male terminals projecting from the male terminal portion. A bracket is connected with the rear edge of a male terminal portion and is used to mount the joint connector on a grounding portion with the male terminals insertable into the respective cavities from the front. When the joint terminal is mounted into the housing, the respective male terminals are inserted into the cavities from the front to be accommodated therein in a standby state. Corresponding pairs of male and female terminals are connected by inserting the respective female terminals connected to ends of ground wires into the cavities from behind. The bracket of the joint terminal is fixed to the grounding portion of the vehicle for grounding the respective ground wires at once.

The female terminals at the ends of the ground wires and the corresponding male terminals of the joint terminal are connected in the common cavities of the housing one housing, thereby making the joint connector smaller in size and lighter.

The female terminals at the ends of the ground wires in the above conventional joint connector are inserted into the cavities and are locked and retained by retaining portions. However, the joint connector is not designed to enable the female terminals to be withdrawn from behind. This is because an insertion error (address error) of the female terminal into the cavity need not be corrected since the ground wires are grounded at once. However, it also has been requested to make female terminals withdrawable from a housing for maintenance and collection.

The invention was developed in view of the above situation and aims to make female terminals insertable and withdrawable while using one housing.

SUMMARY OF THE INVENTION

The invention relates to a joint connector for grounding. The joint connector has a housing and at least one cavity that penetrates the housing in forward and backward directions. A female terminal connected to an end of a wire is insertable the cavity. At least one resilient locking lance is provided in the cavity and engages the female terminal for retaining the female terminal in the cavity. At least one jig insertion opening is formed in the front surface of the housing and can receive a jig for resiliently displacing the locking lance in an unlocking direction. The joint connector also has a joint terminal to be mounted in the housing and to be connected with a male terminal portion with at least one male terminal insertable into the cavity. The joint terminal has a bracket to be mounted on a grounding portion.

The at least one cavity preferably comprises plural side by side cavities that penetrate the housing in forward and backward directions. Female terminals connected to ends of wires are insertable into the cavities from behind. The male terminal portion preferably comprises side by side male terminals that are insertable into the respective cavities from the front.

The invention also is directed to a wiring harness having the above-described joint connector connected to ends of a plurality of ground wires.

According to the above-described construction, the joint terminal is mounted into the housing and the respective male terminals are inserted into the cavities from the front to be accommodated in a standby state. The female terminal connected to the end of the wire then is inserted into the cavity from behind and is connected to the mating male terminal. The locking lance resiliently engages and retains the female terminal. Thereafter, the bracket of the joint terminal is fixed to the grounding portion to ground the respective wires at once.

The female terminal may have to be withdrawn for maintenance or the like. Accordingly, a jig is inserted into the jig insertion opening in the front surface of the housing and resiliently displaces the locking lance to free the female terminal. Thus, the female terminal can be withdrawn by gripping and pulling the wire.

The bracket of the joint terminal may be formed with at least one reinforcing bead at a position deviated from the jig insertion opening when the joint terminal is mounted in the housing. The reinforcing bead increases the bending stiffness against vibration or the like. In addition, the deviation of the reinforcing bead from the jig insertion openings ensures the withdrawal of the female terminals.

A base end portion of the bracket preferably is inserted into the front surface of the housing and the jig insertion openings preferably are located on a top side of the base end portion.

Another reinforcing bead preferably is formed on an underside of the bracket instead of a part of the reinforcing bead formed on the top surface or side.

An attempt could be made to provide the reinforcing bead on the top side of the bracket facing the jig insertion openings while avoiding the jig insertion openings. However, the width of the reinforcing bead is subject to restriction and may disadvantageously affect the strength of the bracket. The reinforcing bead on the underside of the bracket is not subject to restriction. Thus, bending stiffness of the bracket can be increased by forming the other reinforcing bead on the underside instead of the part of the reinforcing bead on the top side. The reinforcing beads on the top side and the underside strengthen the bracket against bending in directions toward the top side and the underside.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
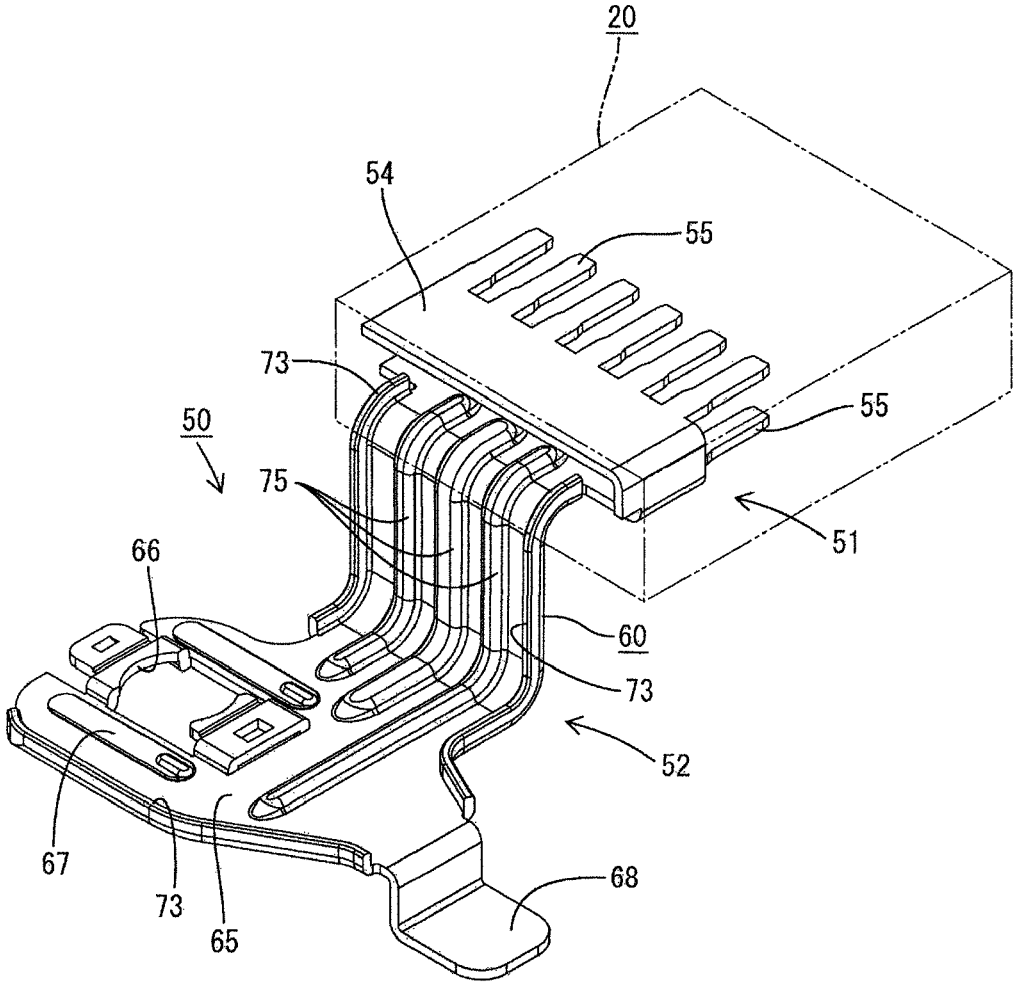
FIG. 1 is a perspective view of a joint terminal according to one embodiment of the invention.
Figure 8:
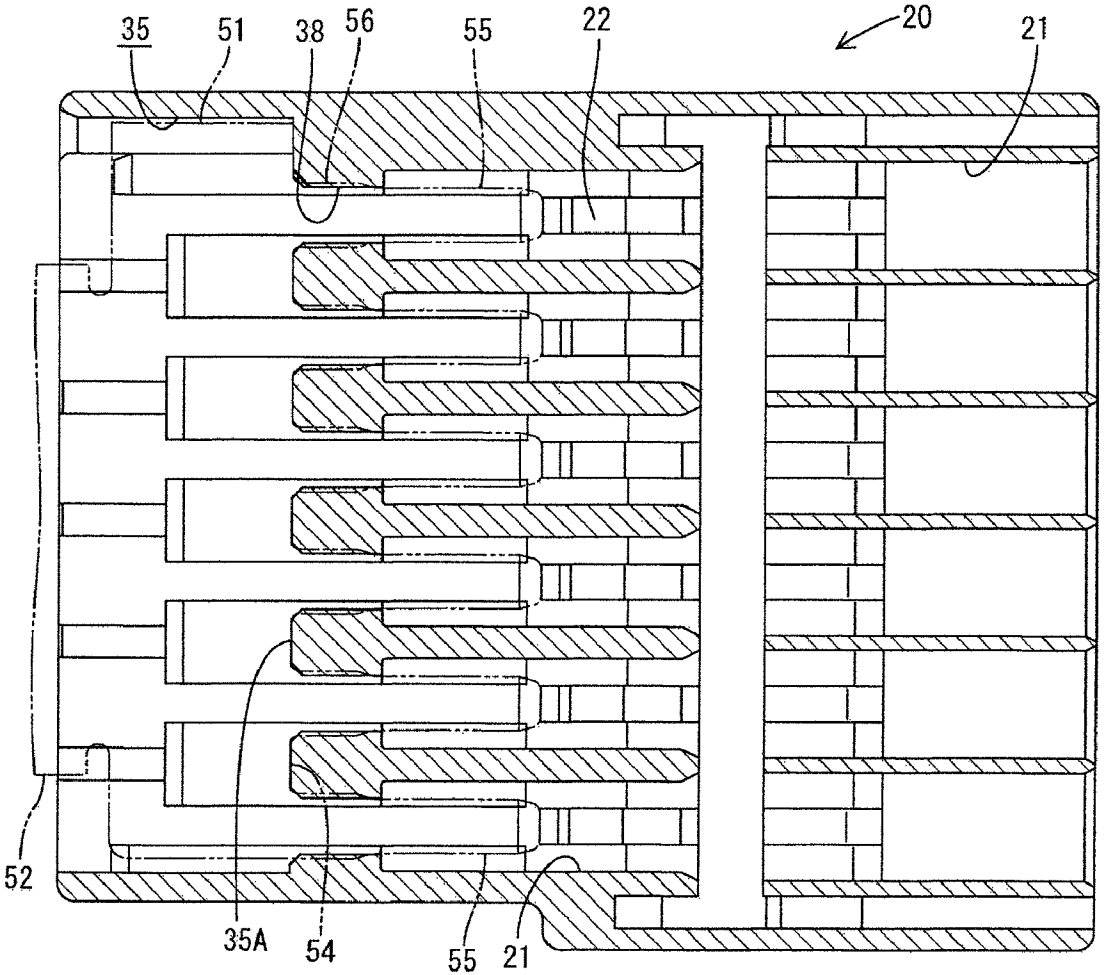
FIG. 8 is a section along VIII-VIII of FIG. 6.
Figure 9:
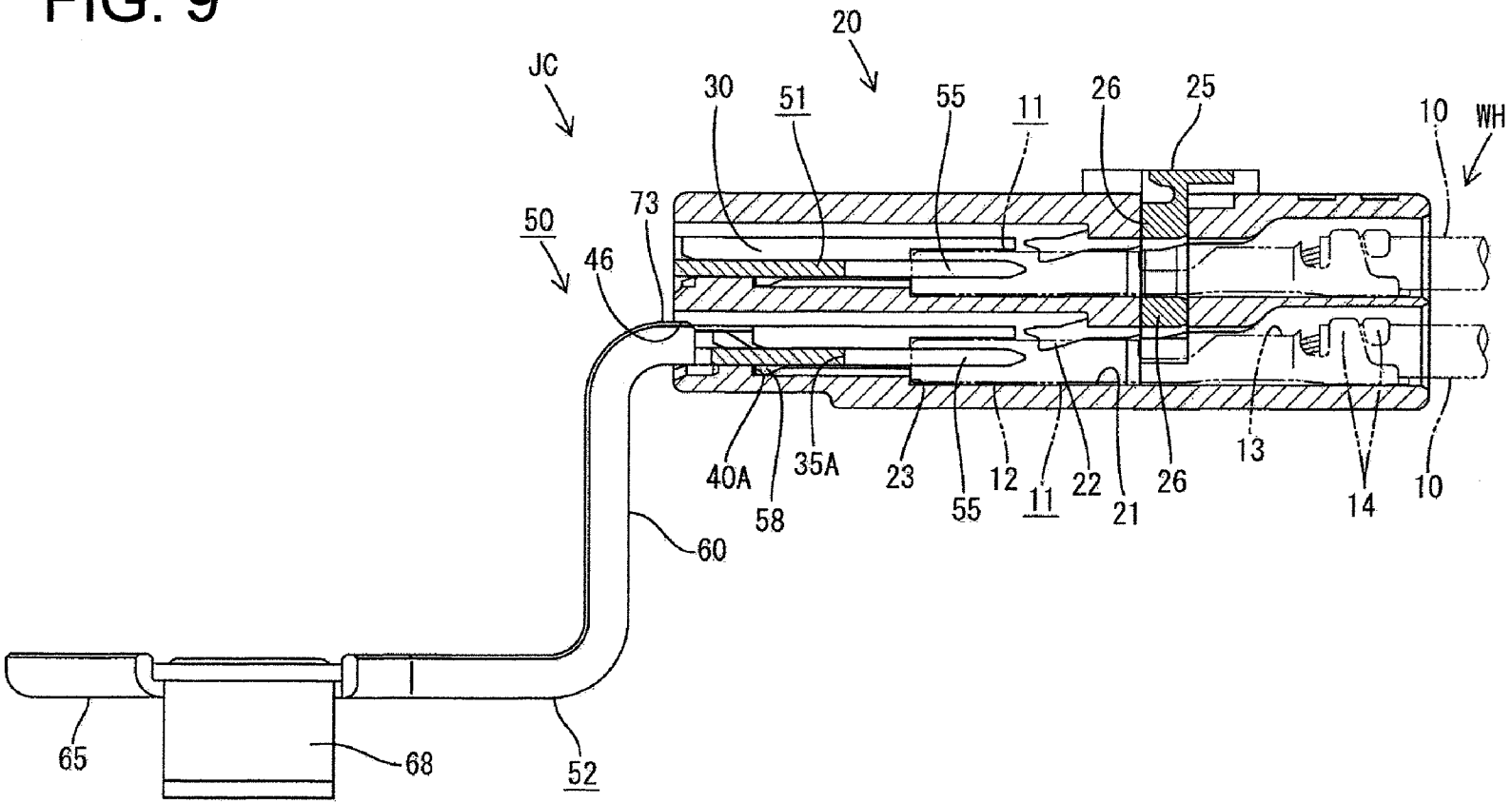
FIG. 9 is a side view in section showing a state where the joint terminal is mounted in the housing.

A joint connector in accordance with the invention is identified by the letters JC in FIGS. 1 to 18. The joint connector JC has a joint terminal 50 with a male terminal portion 51 mounted in a front end of a housing 20. Female terminals 11 connected to ends of respective ground wires 10 are mounted into the housing 20 from behind to be connected to corresponding male terminals 55 of the male terminal portion 51 as shown in FIGS. 1 and 9. The joint terminal 50 has a bracket 52 to be mounted on a grounding portion of a vehicle.

Figure 6:
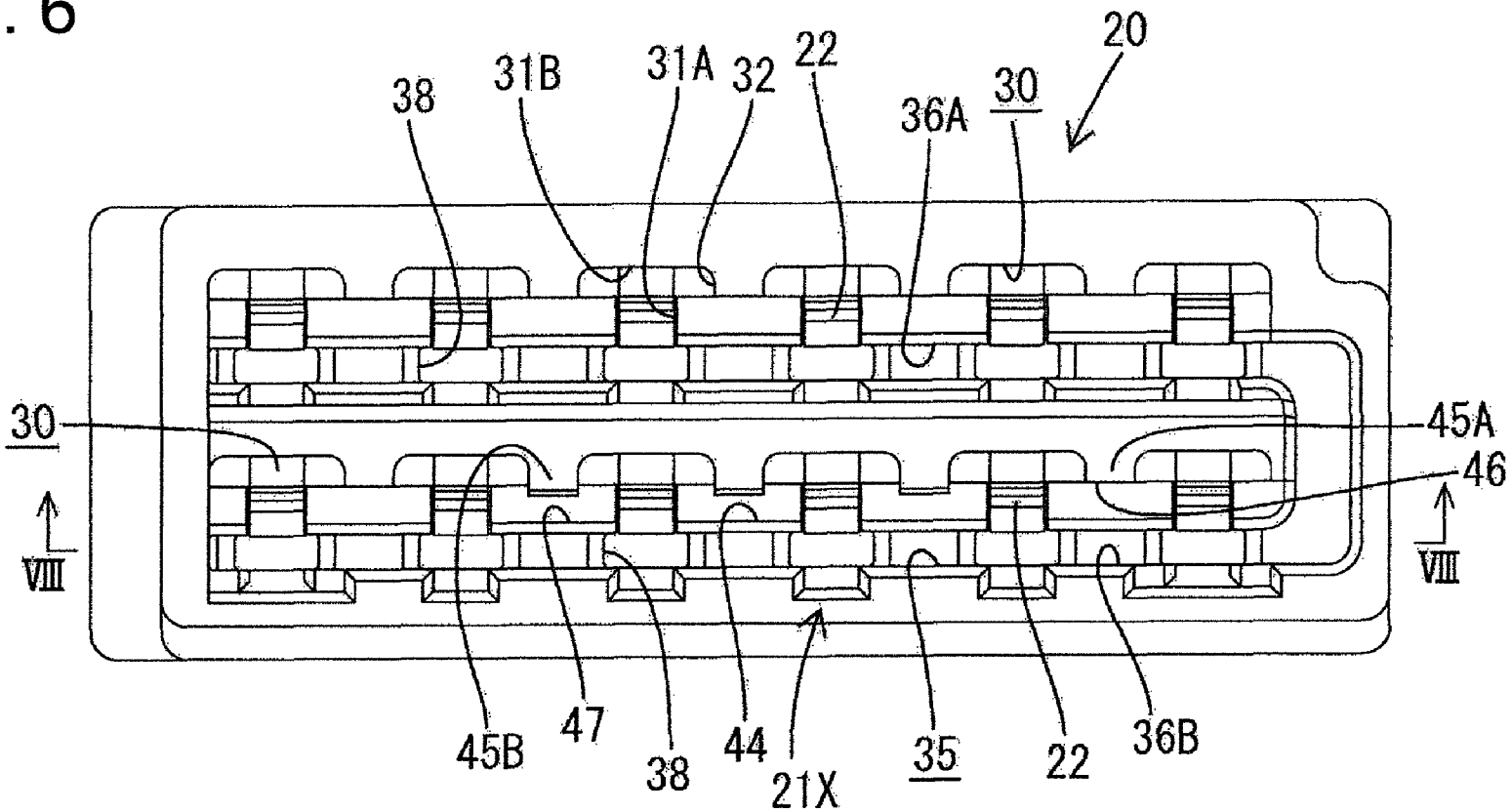
FIG. 6 is a front view of a housing.
Figure 7:
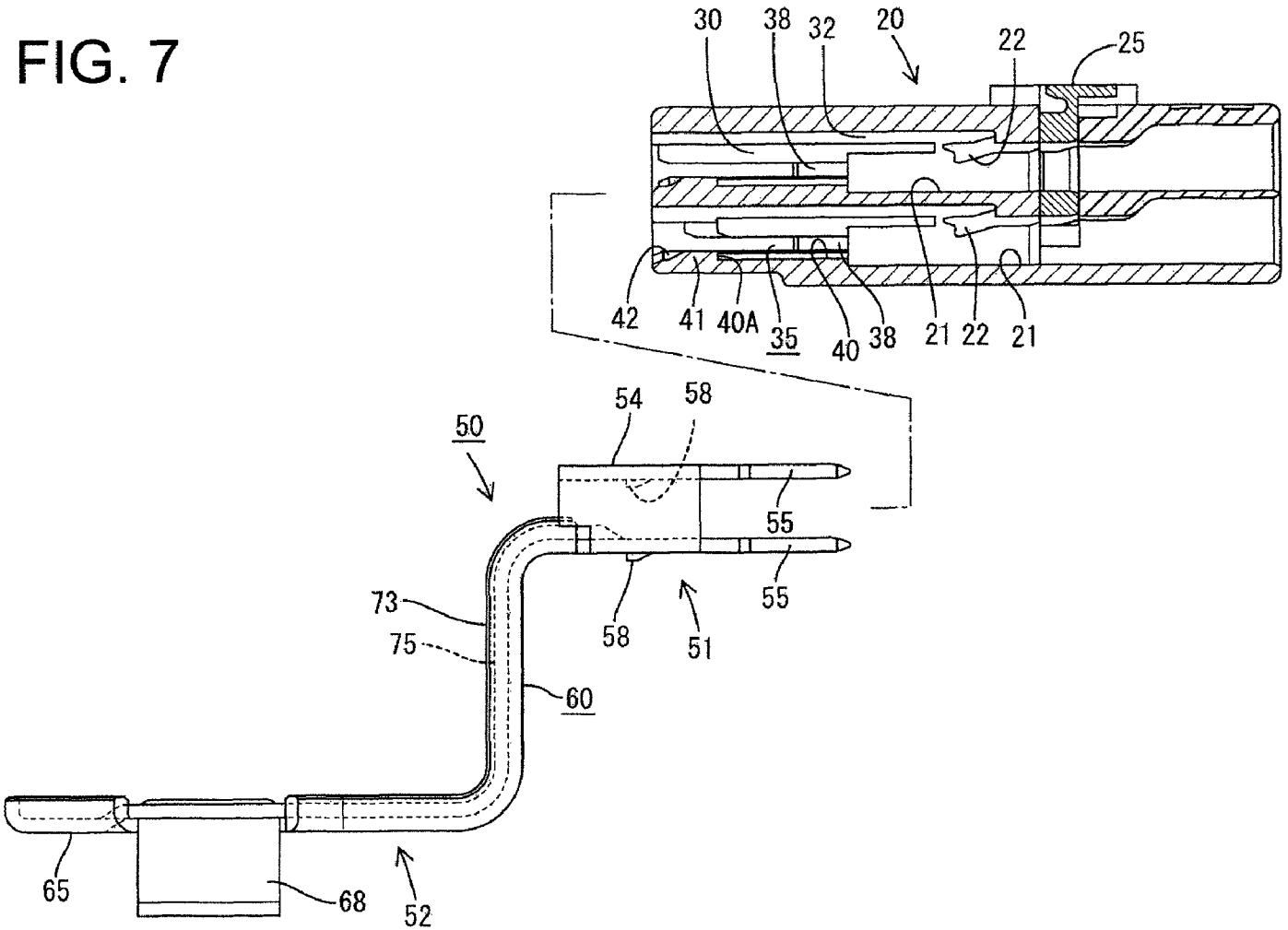
FIG. 7 is a side view partly in section showing an operation of mounting the joint terminal into the housing.

The housing 20 is made e.g. of synthetic resin and is in the form of a substantially flat block, as shown in FIGS. 6 and 7. A front end (left in FIG. 7) defines a mounting area for the male terminal portion 51 of the joint terminal 50, whereas a rear defines a mounting area for the female terminals 11. Six cavities are formed substantially side by side in a width direction in each of upper and lower levels and the female terminals 11 are insertable into the cavities from behind. A resiliently deformable locking lance 22 is provided at the ceiling surface of each cavity 21.

As shown in FIG. 9, each female terminal 11 has wire connection barrels 13, 14 provided behind a rectangular tubular connecting portion 12 that can receive the male terminal 55 of the joint terminal 50. The wire connection barrels 13, 14 are crimped and connected to the end of the ground wire 10. The female terminal 11 is inserted into the cavity 21 from behind and pushed to a proper position while resiliently deforming the locking lance 22. The locking lance 22 resiliently returns when the female terminal 11 contacts a front wall 23 and hence the locking lance 22 fits into a lock hole in the upper surface of the connecting portion 12. Thus, the female terminal 11 is locked primarily and retained. A side-type retainer 25 is mounted on the upper surface of the housing 20. The retainer 25 is pushed to a full locking position so that locking sections 26 secondarily lock the rear edges of the connecting portions 12 of the female terminals 11. Thus, the female terminals 11 are locked doubly.

Figure 2:
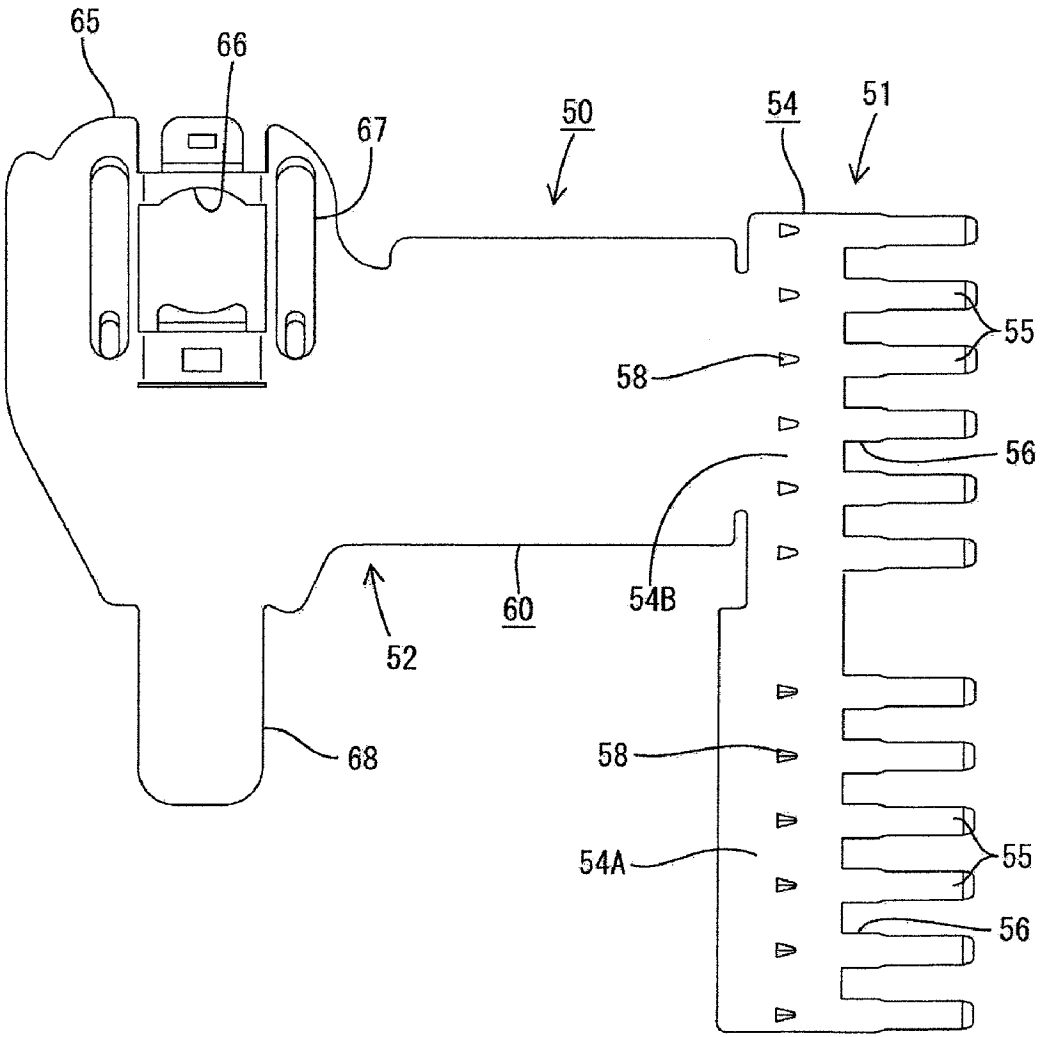
FIG. 2 is a development view of the joint terminal.
Figure 3:
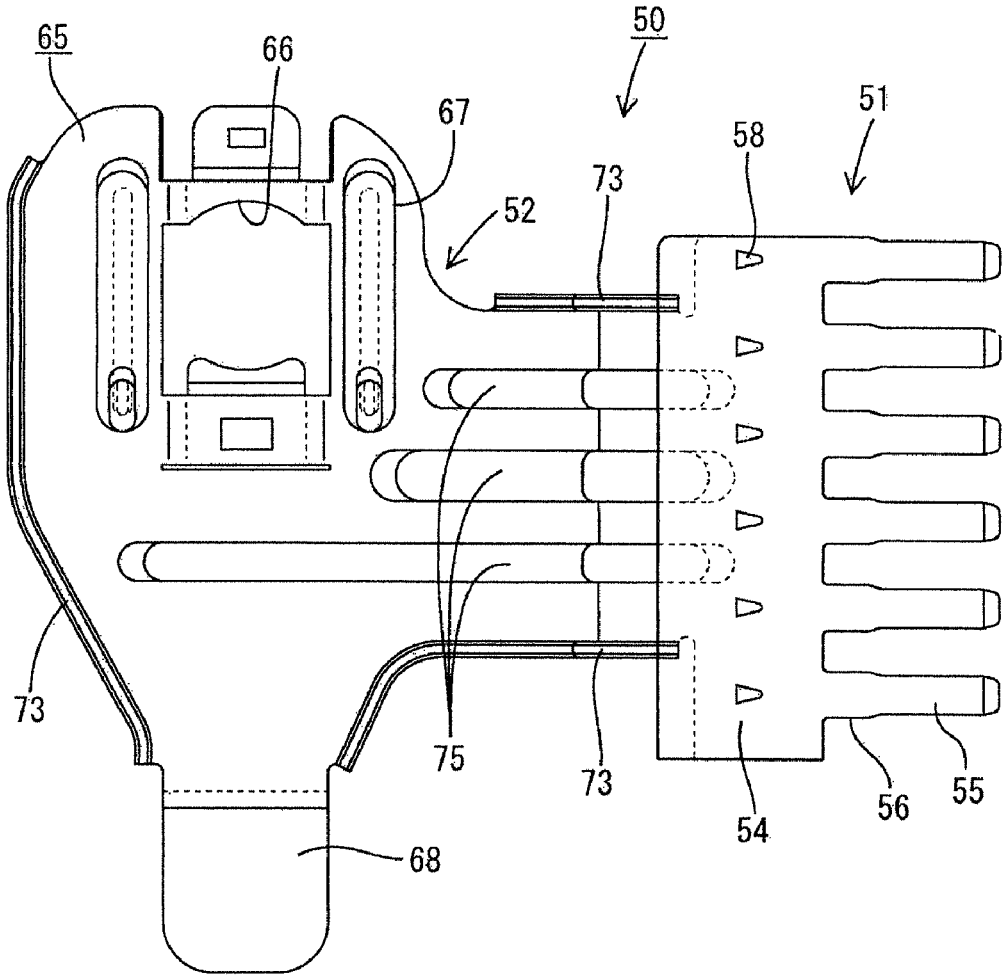
FIG. 3 is a plan view of the joint terminal.
Figure 4:
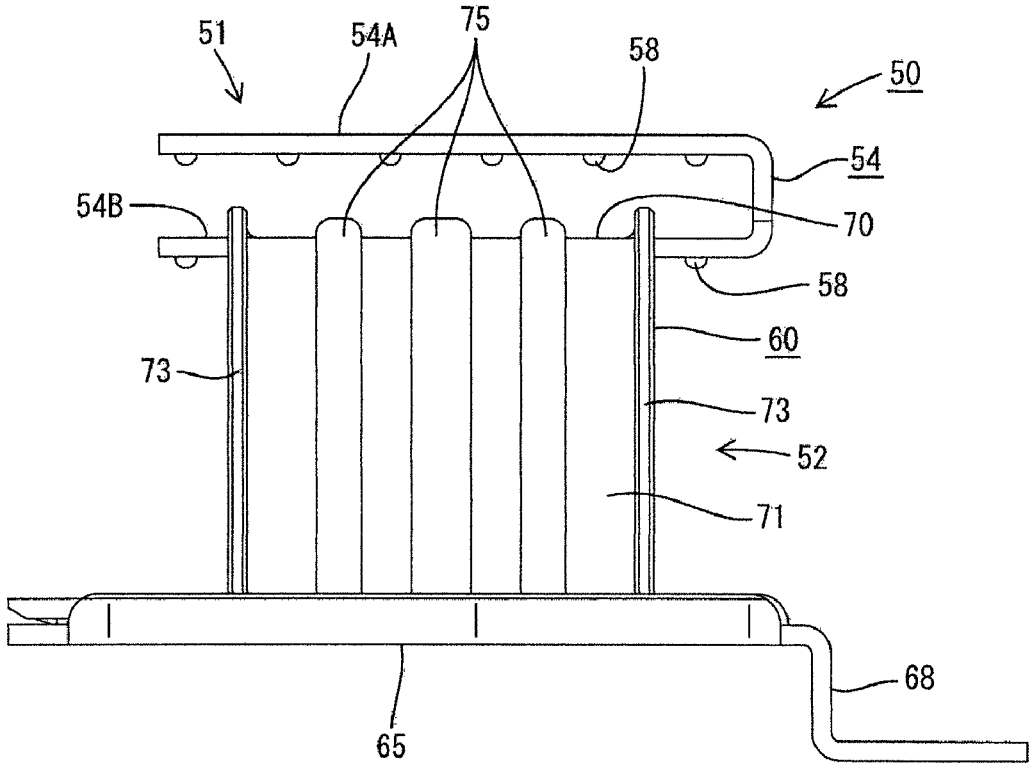
FIG. 4 is a front view of the joint terminal.
Figure 5:
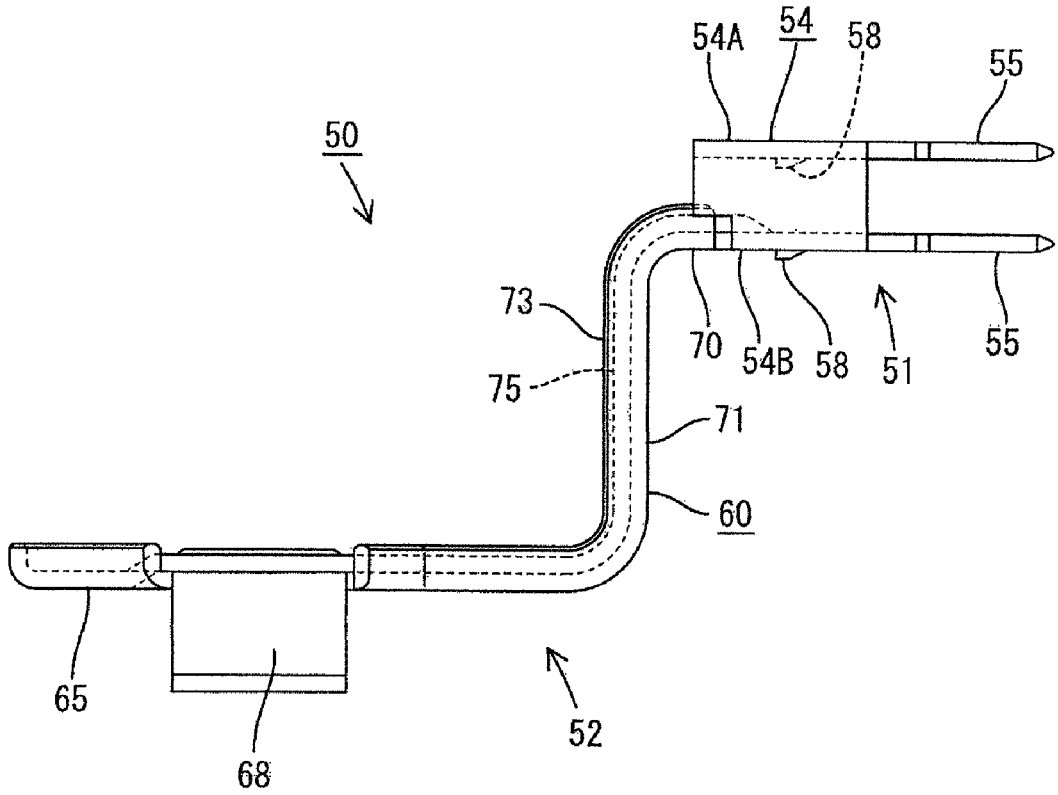
FIG. 5 is a side view of the joint terminal.

The joint terminal 50 is formed by punching or cutting out a conductive metal plate into a developed shape shown in FIG. 2. Bending, folding and/or embossing then is applied to form the joint terminal 50 with a male terminal portion 51 and a bracket 52 connected to the rear edge of the male terminal portion 51 as shown in FIGS. 3 to 5. The bracket 52 is mounted on a grounding portion of the vehicle (not shown).

The male terminal portion 51 has a wide strip shaped coupling 54. The coupling 54 is divided into left and right areas in a width direction, and six tab-shaped male terminals 55 project at substantially regular intervals from the front edge of each of the left and right parts, as shown in FIG. 2. The arrangement interval of the male terminals 55 is the same as the arrangement interval of the cavities 21 of the housing 20. The leading end of each male terminal 55 is tapered for guiding and a widened press-fitting portion 56 is defined along a specified length area (about ¼ length area) at the base end of each male terminal 55.

The male terminal portion 51 is folded by 180° at a widthwise intermediate part of the coupling 54 so that the lower part in FIG. 2 is folded to be spaced above the other part by substantially the same distance as the interval between the upper and lower cavities 21 in the housing 20. Accordingly, the bent male terminal portion 51 has six male terminals 55 in each of upper and lower levels in an arrangement conforming to the cavities 21. The coupling 54 defines a flat channel that opens laterally and the male terminals 55 project forward from the front edges of upper and lower portions 54A and 54B of the coupling 54. The upper and lower portions 54A, 54B of the coupling 54 are hammered to form downward projecting locking projections 58 on backward extensions of center lines of the respective male terminals 55.

As shown in the developed state of FIG. 2, the bracket 52 extends back from a widthwise central part of the rear edge of the lower portion 54B of the coupling 54 of the male terminal portion 51. Specifically, a leg 60 is formed in a length area slightly longer than half the length of the bracket 52 at a base end side and has a constant width slightly narrower than the lower portion 54B. A mounting portion 65 is formed at a leading end and has a lateral (e.g. left) edge that bulges slightly out. A mounting hole 66 is formed in the mounting portion 65 near the bulge. An unillustrated stud bolt extends from the grounding portion of the vehicle and is insertable into the mounting hole 66. Placing portions 67 are formed at edge portions on the top side of the mounting hole 66 and can receive another ground terminal or the like. A tongue shaped rotation preventing portion 68 projects from the right edge of the mounting portion 65.

The bracket 52 is bent at a right angle at an intermediate position of the leg 60 to extend down and then is bent at a joint between the leg 60 and the mounting portion 65 to extend back, as shown in FIGS. 1 and 5. Thus, the bracket 52 has a crank shape. More specifically, the bracket 52 is formed such that the L-shaped leg 60 has a substantially horizontal surface 70 extending back flush with the lower portion 54B of the coupling 54 and a substantially downward extending vertical surface 71 continuous with the leading end of the horizontal surface 70. The mounting portion 65 projects substantially horizontally back at the bottom end of the vertical surface 70 of the leg 60. Note that the tongue of the mounting portion 65 also is bent into an L-shape to form the rotation preventing portion 68.

The front surface of the housing 20 has jig insertion grooves 30 that enable insertion of a jig 80 for individually resiliently displacing the locking lances 22 in the respective cavities 21 in an unlocking direction. Each jig insertion groove 30 is formed before the corresponding locking lance 22 and has a substantially T-shaped cross section by connecting a horizontal section 31B at the upper end of a vertical section 31A having a width equivalent to that of the locking lance 22, as shown in detail in FIG. 14. Opposite ends of the horizontal section 31B define guides 32.

Figure 16:
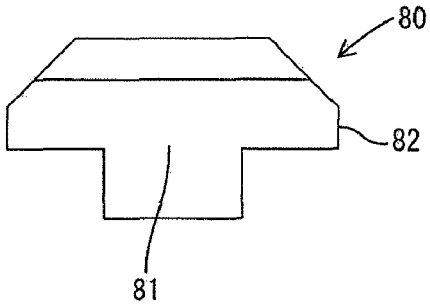
FIG. 16 is an enlarged front view of a jig.
Figure 17:
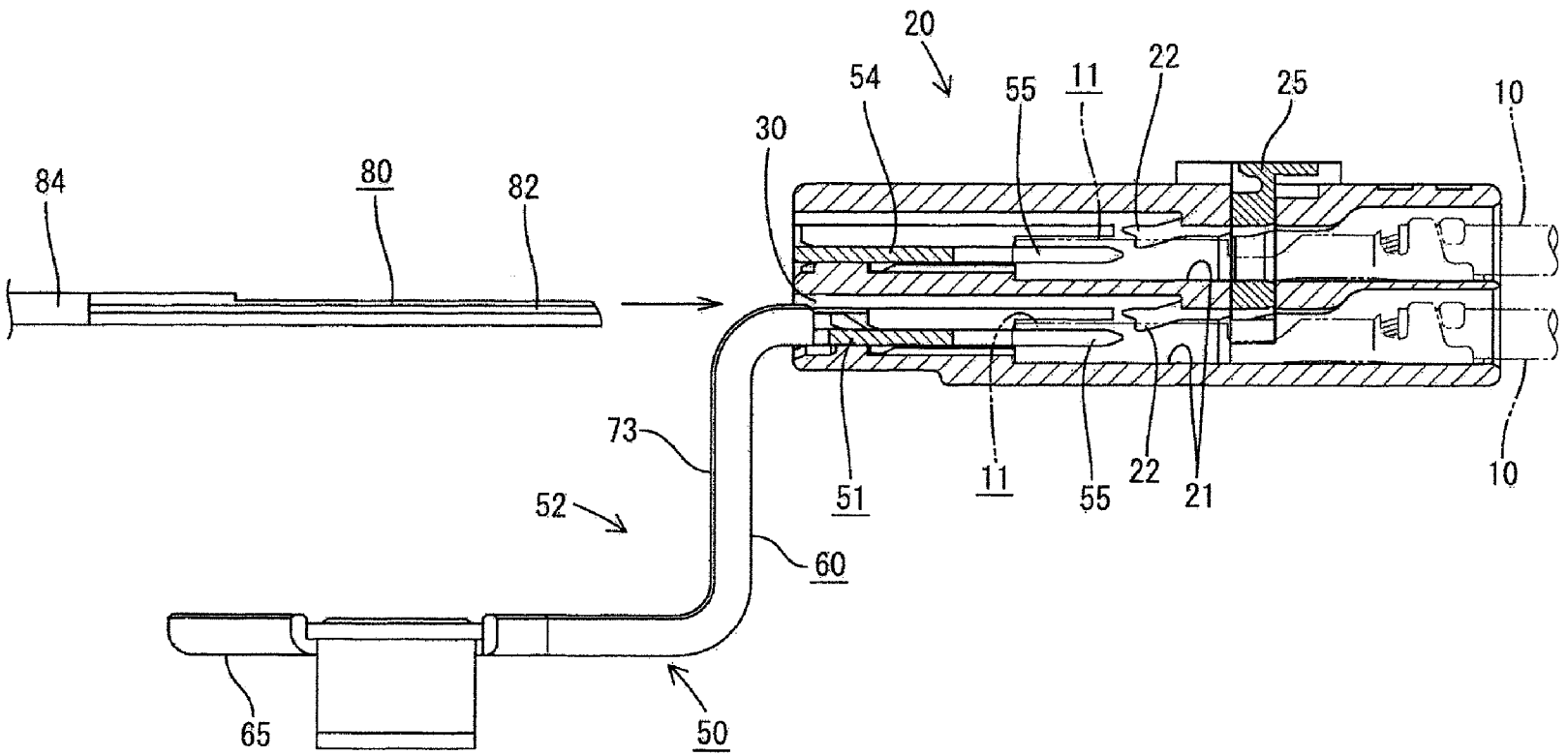
FIG. 17 is a side view partly in section showing an operation of unlocking a locking lance.

As shown in FIGS. 16 and 17, the jig 80 has a mating T-shaped cross section in conformity with the jig insertion grooves 30. A pressing portion 81 is defined at the leading end of the jig 80 for engaging and pressing the leading end of the locking lance 22. A horizontal section 82 has both ends fit into the guides 32. The jig 80 is provided at the leading end of a handle 84, so that the jig 80 can be inserted into and withdrawn from the jig insertion groove 30 by gripping the handle 84.

A terminal insertion groove 35 is formed in the front surface of the housing 20 and can receive the male terminal portion 51 of the joint terminal 50. As shown in FIG. 6, the terminal insertion groove 35 is a flat channel with an open side that conforms with the shape of the coupling 54 of the male terminal portion 51. Upper and lower groove portions 36A, 36B are formed below the cavities 21 in the respective upper and lower levels and communicate with the bottom ends of the vertical sections 31A of the jig insertion grooves 30. Further, as shown in FIG. 9, a back surface 35A of the terminal insertion groove 35 is spaced from the front surface of the housing 20 by a distance that is more than about half (e.g. at about ⅔) of a distance between the front surface of the housing 20 and the fronts of the cavities 21.

Press-fitting holes 38 extend from the back surfaces of the upper and lower groove portions 36A, 36B of the terminal insertion groove 35 to the corresponding cavities 21. The press-fitting holes 38 are slightly smaller than the press-fitting portions 56 at the base ends of the male terminals 55 so that the press-fitting portions 56 can be press-fit into the press-fitting holes 38.

Locking grooves 40 are formed right below the respective press-fitting holes 38 and extend from the front surfaces of the cavities 21 to a positions spaced rearward from the front surface of the housing 20 by a distance slightly less than ⅓ of the distance from the front surface of the housing 20 to the cavities 21. Locking surfaces 40A are formed at the front ends of the locking grooves 40 and engage the locking projections 58 on the coupling portion 54 of the joint terminal 50.

An introducing opening 42 extends into the front surface of the housing 20 before each locking groove 40 and a wall 41 is located between the introducing opening 42 and the locking groove 40.

The male terminal portion 51 of the joint terminal 50 is inserted into the terminal insertion groove 35 in the front surface of the housing 20 so that the leading ends of the respective male terminals 55 enter the corresponding terminal press-fitting holes 38 in an intermediate stage of insertion. The press-fitting portions 56 at the base ends of the male terminals 55 bite into the left and right walls of the press-fitting holes 38 at a final stage of insertion so that the male terminals 55 are press-fit. Insertion is stopped when the front edge of the coupling 54 contacts the back surface 35A of the terminal insertion groove 35, as shown in FIG. 8. In the meantime, the locking projections 58 enter through the introducing openings 42, pass the walls 41 and then fit into the locking grooves 40 to engage the locking surfaces 40A, as shown in FIG. 9, for retaining the male terminal portion 51.

At this time, the respective male terminals 55 of the male terminal portion 51 project a specified distance into the corresponding cavities 21 and are accommodated in a standby state. Further, the horizontal surface 70 of the leg 60 of the bracket 52 is located in the width direction to correspond to an arrangement area of a cavity row 21X particularly composed of the four middle cavities 21 in the lower level. The opposite left and right edges of the horizontal surface 70 are at partition parts between the cavities at the opposite ends of the cavity row 21X and the outermost cavities 21.

The bracket 52 is formed with reinforcing beads. First reinforcing beads are flanges 73 formed by bending end edges of the bracket 52 up at a substantially right angle toward the top to have a predetermined height. The flanges 73 are at three positions, namely: on the left edge of the leg 60 from the horizontal surface 70 to the vertical surface 71; in an area extending from the right edge of the leg 60 from the horizontal surface 70 to the vertical surface 71 and continuing to the rear end edge of the rotation preventing portion 68; and on the front edge of the mounting portion 65. Significantly, the flanges 73 on the left and right edges of the horizontal surface 70 of the leg 60 are deviated out from the respective jig insertion grooves 30 formed in correspondence with the cavities 21 at the opposite ends of the four-cavity row 21X.

Second reinforcing beads are ribs 75 formed by hammering the leg 60 to project toward the top. In a shown example, three ribs 75 are formed in a widthwise central part of the leg 60 to extend partly to the mounting portion 65. More specifically, the respective ribs 75 correspond to partition parts between adjacent cavities 21 of the four-cavity row 21X. Base ends of the ribs 75 are at a joint between the horizontal surface 70 of the leg 60 and the coupling 54. Ends of the right and middle ribs 75 are behind the rear placing portion 67. The left rib 75 passes on the right side of the rear placing portion 67 and reaches the vicinity of the front end edge. The three ribs 75 have substantially equal heights slightly shorter than the flanges 73. However, the middle rib 75 is slightly wider than the ribs 75 at the opposite ends. A widthwise central part of the vertical surface 71 of the bracket 52 is most distant from the flanges 73 at the opposite sides and may be poor in strength if the vertical surface 71 is long. Therefore, a sufficient strength is ensured by providing the wide rib 75 at this position.

The three ribs 75 in the intermediate part of the horizontal surface 70 of the leg 60 are arranged so as not to interfere with the jig insertion grooves 30 on the opposite sides at the respective positions between the adjacent cavities 21 of the four-cavity row 21X.

Fitting recesses 44 are formed at positions right above the lower groove portion 36B of the terminal insertion groove 35 in the front surface of the housing 20, i.e. at positions corresponding to height areas of the vertical sections 31A of the jig insertion grooves 30 in the lower level. Base ends of the flanges 73 and the ribs 75 on the horizontal surface 70 of the leg 60 are insertable into the fitting recesses 44. Back surfaces of the fitting recesses 44 align with the locking surfaces 40A of the locking grooves 40.

The ceiling surfaces of the fitting recesses 44 have a predetermined width only at the positions where the flanges 73 and the ribs 75 are fit, as shown in FIG. 6, due to the horizontal sections 31B of the jig insertion grooves 30 in the lower level. Receiving portions 46 are formed between ceilings 45A at the opposite ends of left five ceiling portions and the bottom surfaces of the corresponding fitting recesses 44 and can receive the flanges 73. The ceiling portions 45A are slightly lower than the heights of the flanges 73. Thus, the flanges 73 are inserted into the receiving portions 46 while slightly biting into the ceiling surfaces, i.e. press-fitted.

Receiving portions 47 are formed between three middle ceiling portions 45B and the bottom surfaces of the corresponding fitting recesses 44 for receiving the ribs 75. Heights of the ceiling surfaces in the ceiling portions 45B substantially equal the heights of the ribs 75. Therefore the ribs 75 are inserted closely into the receiving portions 47.

As shown in FIG. 7, the joint terminal 50 is mounted from the front into the housing 20 while the retainer 25 is at a partial locking position. Specifically, the male terminal portion 51 of the joint terminal 50 is inserted into the terminal insertion groove 35 in the front surface of the housing 20 so that the male terminals 55 enter the cavities 21 and are press-fit into the terminal press-fitting holes 38. Insertion is stopped when the front edge of the coupling 54 of the male terminal portion 51 contacts the back surface 35A of the terminal insertion groove 35, as shown in FIG. 8. At this time, as shown in FIG. 9, the locking projections 58 enter the corresponding locking grooves 40 and engage the locking surfaces 40A to retain the male terminal portion 51. The respective male terminals 55 of the male terminal portion 51 are accommodated in the standby state while projecting the predetermined distance into the corresponding cavities 21 from the front.

Figure 10:
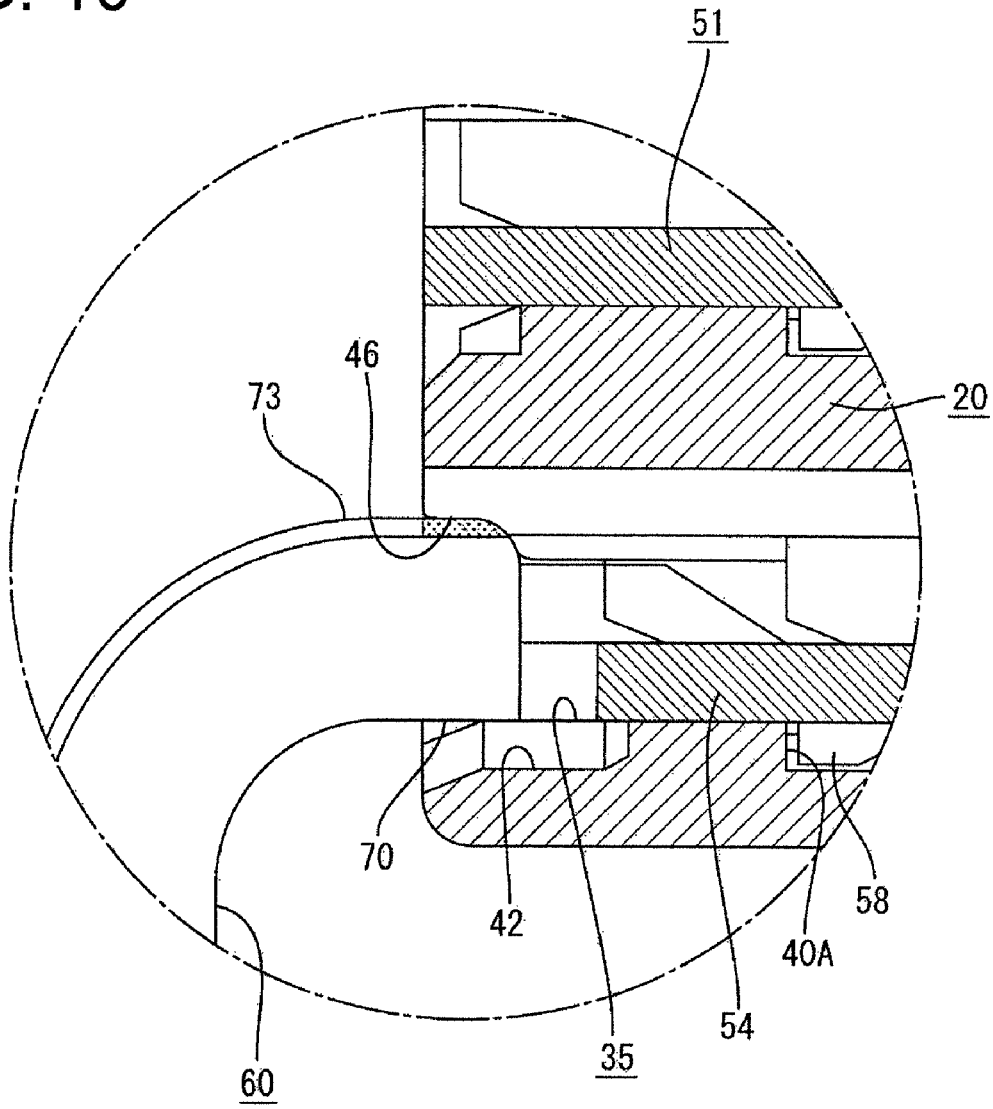
FIG. 10 is a partial enlarged view of FIG. 9.
Figure 11:
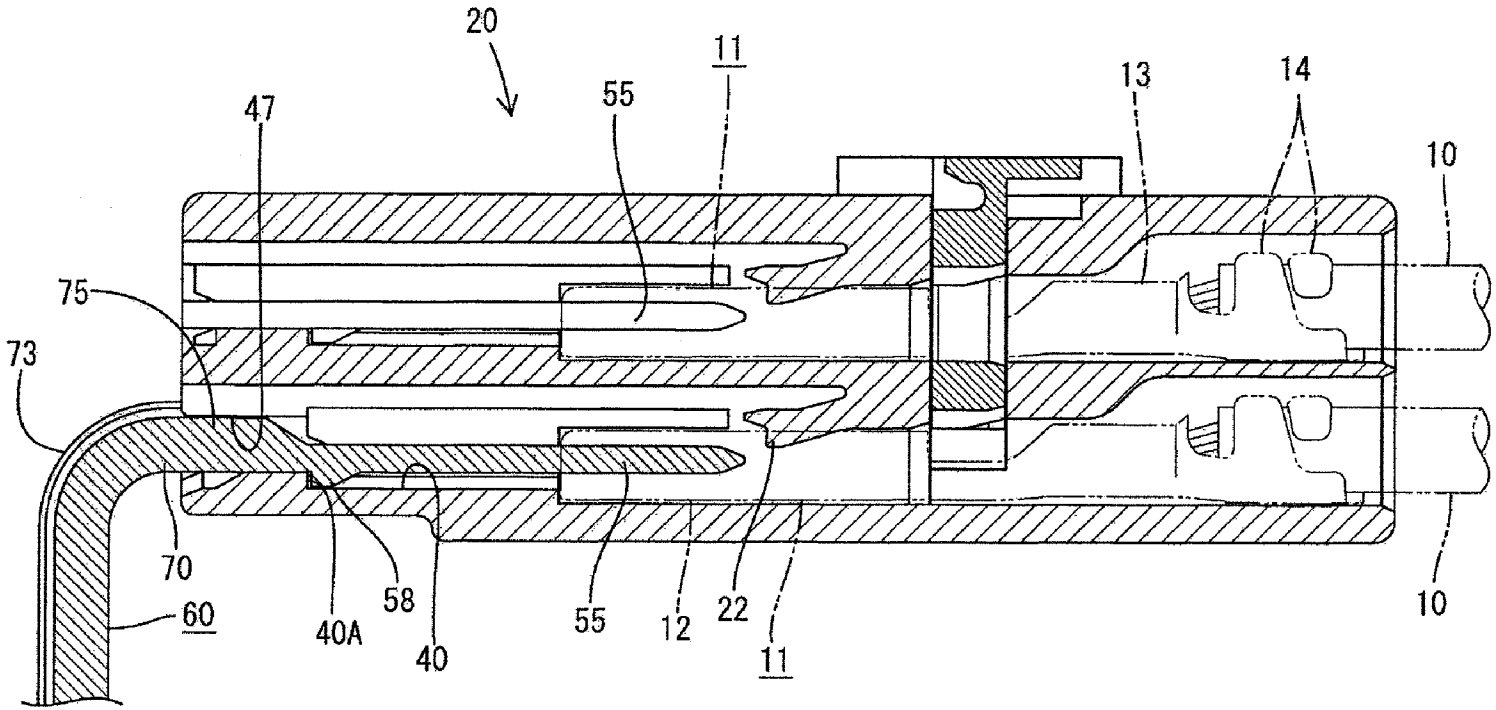
FIG. 11 is a side view in section showing a structure of a part tightly holding ribs in the state where the joint terminal is mounted in the housing.
Figure 12:
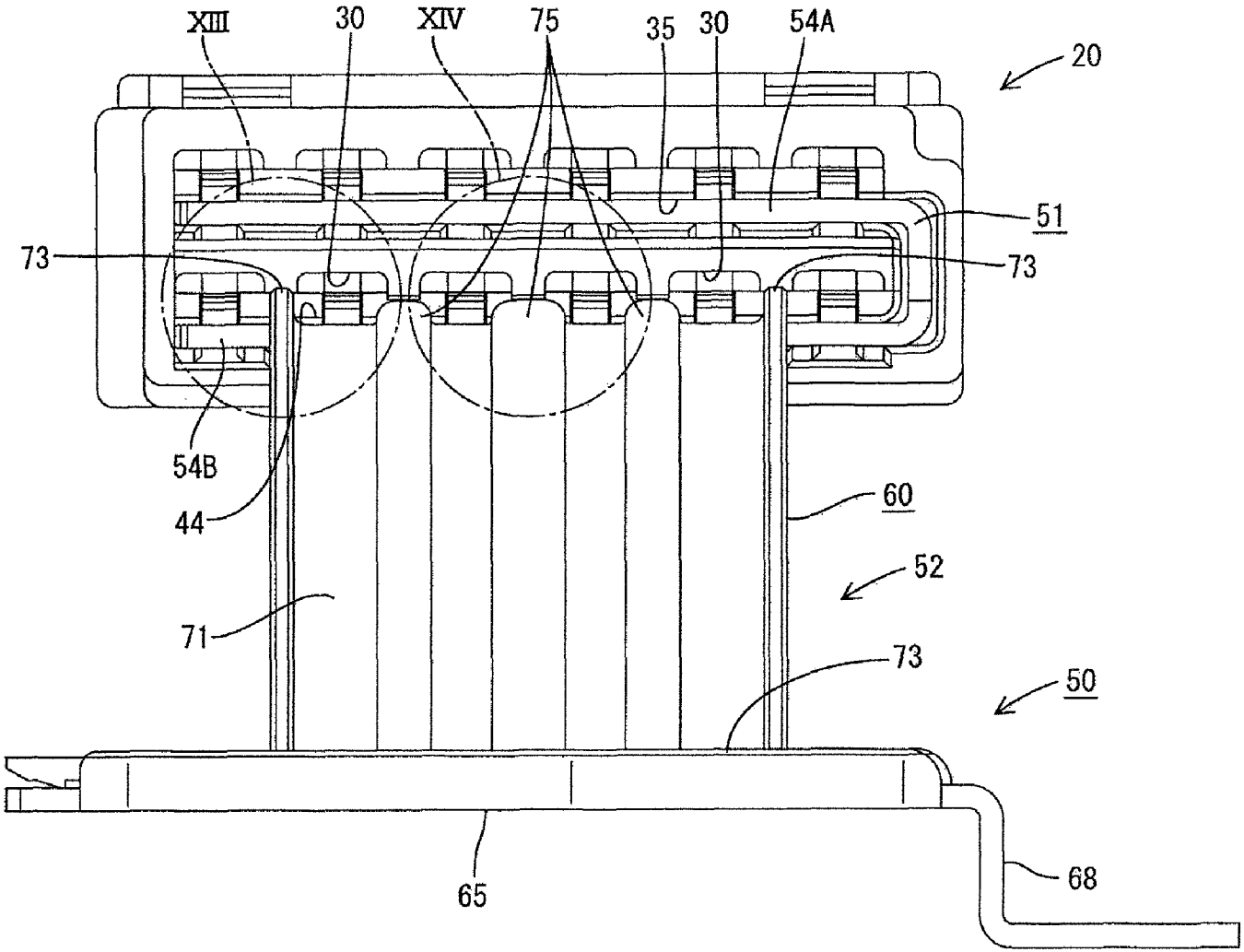
FIG. 12 is a front view showing the state where the joint terminal is mounted in the housing.
Figure 13:
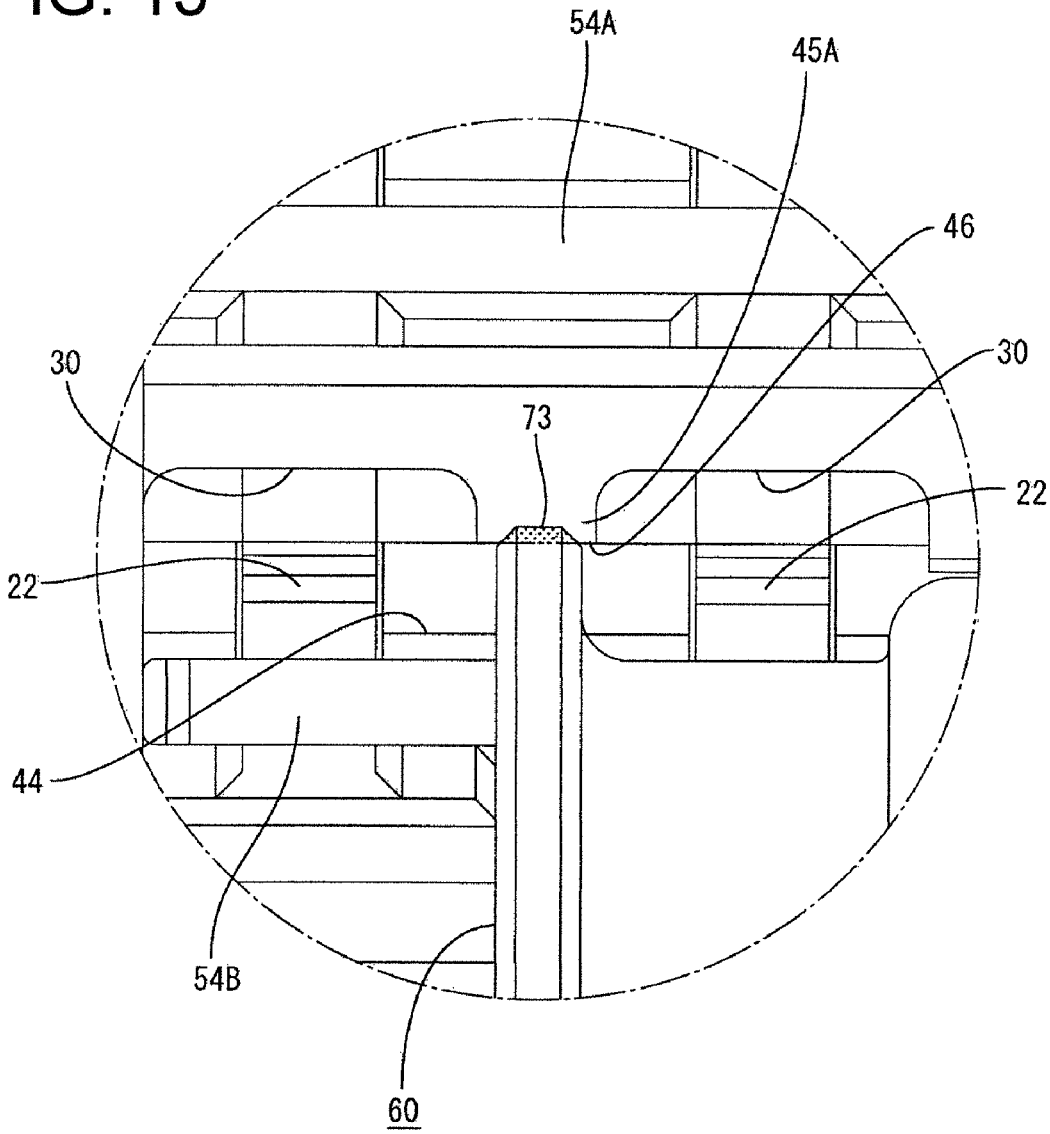
FIG. 13 is an enlarged view of an area XIII in FIG. 12.
Figure 14:
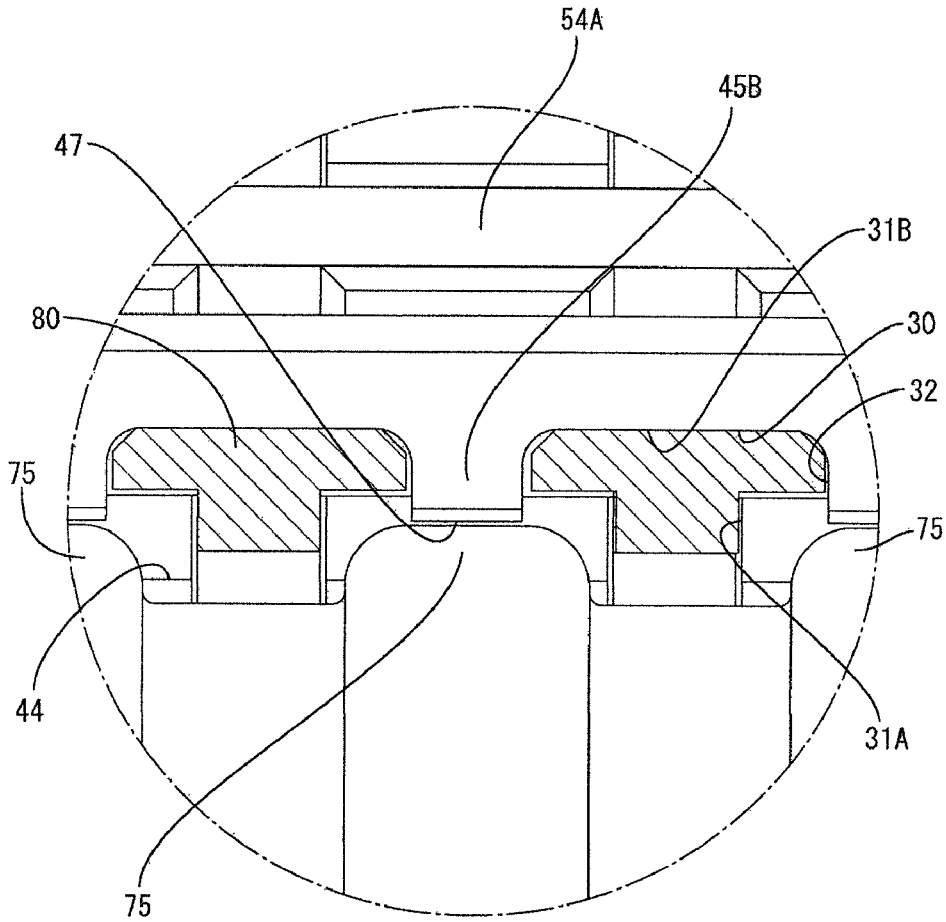
FIG. 14 is an enlarged view of an area XIV in FIG. 12.
Figure 15:
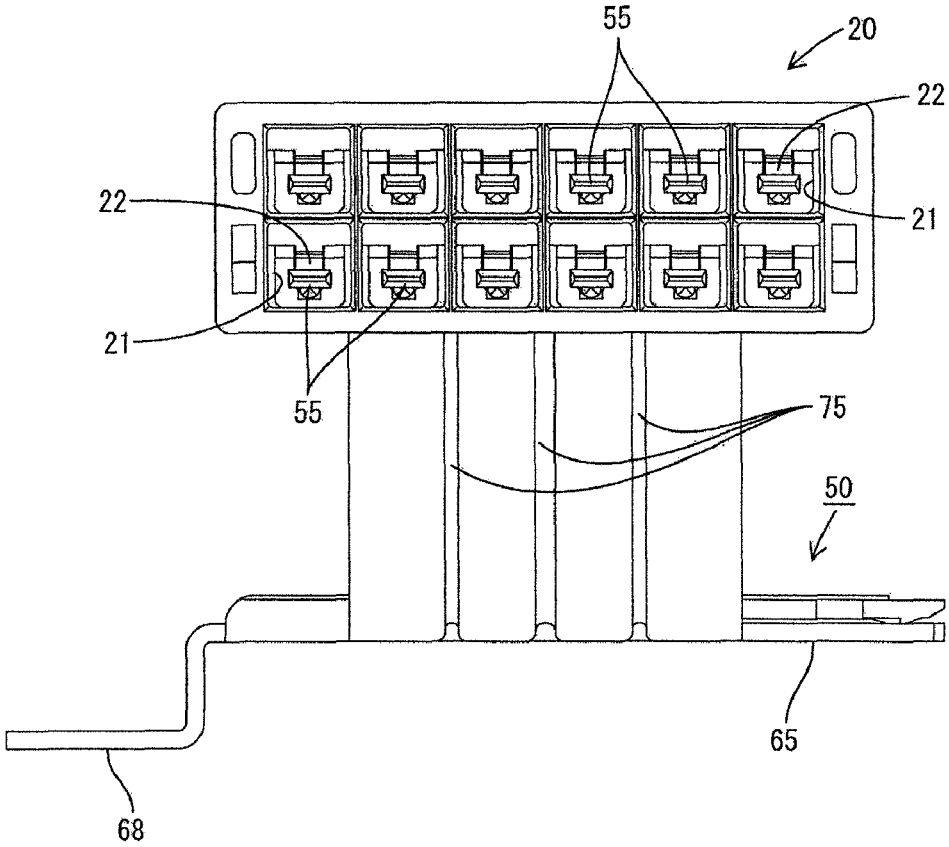
FIG. 15 is a rear view showing the state where the joint terminal is mounted in the housing.

During this time, the base end of the horizontal surface 70 of the leg 60 of the bracket 52 is fit into the fitting recesses 44, as shown in FIG. 12. Particularly, the flanges 73 at the opposite widthwise ends are press-fit into front areas of the receiving portions 46 for the flanges 73, as shown in FIGS. 9, 10 and 13, and the three ribs 75 in the widthwise central part are inserted closely to the back ends of the receiving portions 47 for the ribs 75 as shown in FIGS. 11 and 14.

The female terminals 11 fixed to the ends of the ground wires 10 of the wiring harness WH are inserted from behind into the corresponding cavities 21 of the housing 20 that have had the joint terminal 50 assembled beforehand, as described above. Each female terminal 11 is pressed to displace the locking lance 22. Accordingly, the mating male terminal 55 in the standby state enters the connecting portion 12 from front. The locking lance 22 returns resiliently to fit into the lock hole when the female terminal 11 is pushed to a proper position, as shown by chain line in FIG. 9, and locks the female terminal 11. Simultaneously, the female and male terminals 11, 55 are connected properly since the male terminal 55 is inserted to a proper depth into the connecting portion 12. When all the female terminals 11 are inserted properly, the retainer 25 is pushed to the engaging position to lock the respective female terminals 11 doubly. In this way, the joint connector JC is connected to the end of the ground wiring harness.

The joint connector JC connected to the end of the wiring harness WH is mounted on the grounding portion of the vehicle. More specifically, the stud bolt standing from the grounding portion is inserted into the mounting hole 66 in the mounting portion 65 of the bracket 52 of the joint terminal 50 projecting forward from the housing 20. The nut is tightened onto this stud bolt and fixes the mounting portion 65 closely to the grounding portion. At this time, the rotation preventing portion 68 engages the grounding portion so that the nut can be tightened without the mounting portion 65 following a rotating movement of the nut. In this way, the ground wires 10 are grounded at once.

Other ground wires also can be grounded by placing and connecting a ground terminal at ends of the other ground wires on the placing portions 67.

The leg 60 of the bracket 52 of the joint terminal 50 has a relatively large height and the housing 20 is connected at the upper end of the leg 60. Thus, a bending force is likely to act on a joint between the base end of the leg 60 and rear edge of the male terminal portion 51, such as when the joint connector JC is subject to vibration or the like while the vehicle is running. However, the flanges 73 and the ribs 75 at the base end of the horizontal surface 70 are press-fit into the corresponding receiving portions 46, 47. Therefore the bending force is received by the receiving portions 46, 47 and a bending strength is increased.

Figure 18:
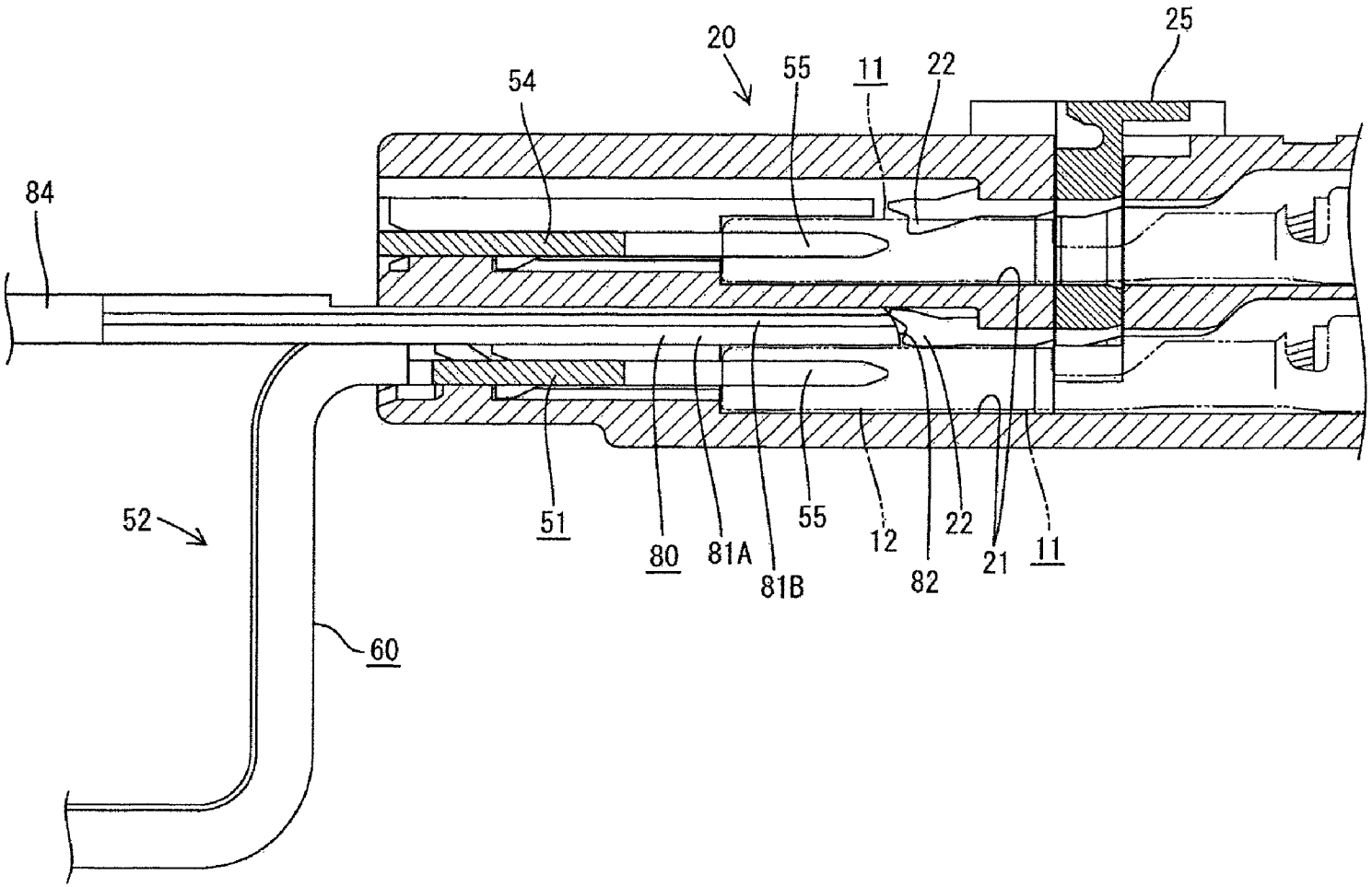
FIG. 18 is a side view in section showing a state where the locking lance is unlocked.

The female terminals 11 may have to be detached from the housing 20 for maintenance or other purposes. Thus, the nut that fixes the bracket 52 of the joint terminal 50 is loosened and detached to detach the joint connector JC from the grounding portion. Subsequently, the retainer 25 mounted in the housing 20 is returned to the partial locking position and the jig 80 is inserted in a specified posture into the jig insertion groove 30, as shown in FIG. 17. The pressing portion 81 at the leading end of the jig 80 then presses the leading end of the locking lance 22 when the jig 80 is inserted to a predetermined depth and forcibly displaces the locking lance 22 in the unlocking direction, as shown in FIG. 18. Thus, the female terminal 11 is freed from the locking lance 22. The female terminal 11 can be pulled back out of the cavity 21 by gripping the corresponding ground wire 10 and pulling it backward.

According to this embodiment, the female terminals 11 at the ends of the respective ground wires 10 and the corresponding male terminals 55 of the joint terminal 50 are be connected in the cavities 21 of the common housing 20, i.e. connected using one housing 20. Thus, the joint connector JC is small and light. In addition, the female terminals 11 of the ground wires 10 can be withdrawn from the cavities 21 of the housing 20 using the jig 80, which is convenient at the time of maintenance, collection, etc.

The joint connector JC mounted on the grounding portion may be subject to vibration while the vehicle is running. Thus, a large bending force is likely to act on the joint between the base end of the leg 60 of the bracket 52 and the male terminal portion 51 in the joint terminal 50. As a countermeasure, the leg 60 of the bracket 52 has an L-shape with the horizontal surface 70 that extends from the rear edge of the male terminal portion 51 and the substantially downward extending vertical surface 71 continuous with the leading end of the horizontal surface 70. The flanges 73 and the ribs 75 as the reinforcing beads are formed up to the base end of the horizontal surface 70 that serves as the joint with the male terminal portion 51. Back ends of the flanges 73 and ribs 75 are held tightly by being fit into the corresponding receiving portions 46, 47 in the housing 20.

Thus, a bending strength at the joint between the base end of the leg 60 of the bracket 52 and the male terminal portion 51 is increased to prevent breakage and the like. In addition, the flanges 73 and the ribs 75 are provided at positions so as not to interfere with the jig insertion grooves 30 used to insert the jig 80 to detach the female terminals 11. Thus, the withdrawal of the female terminals 11 also is ensured.

Figure 19:
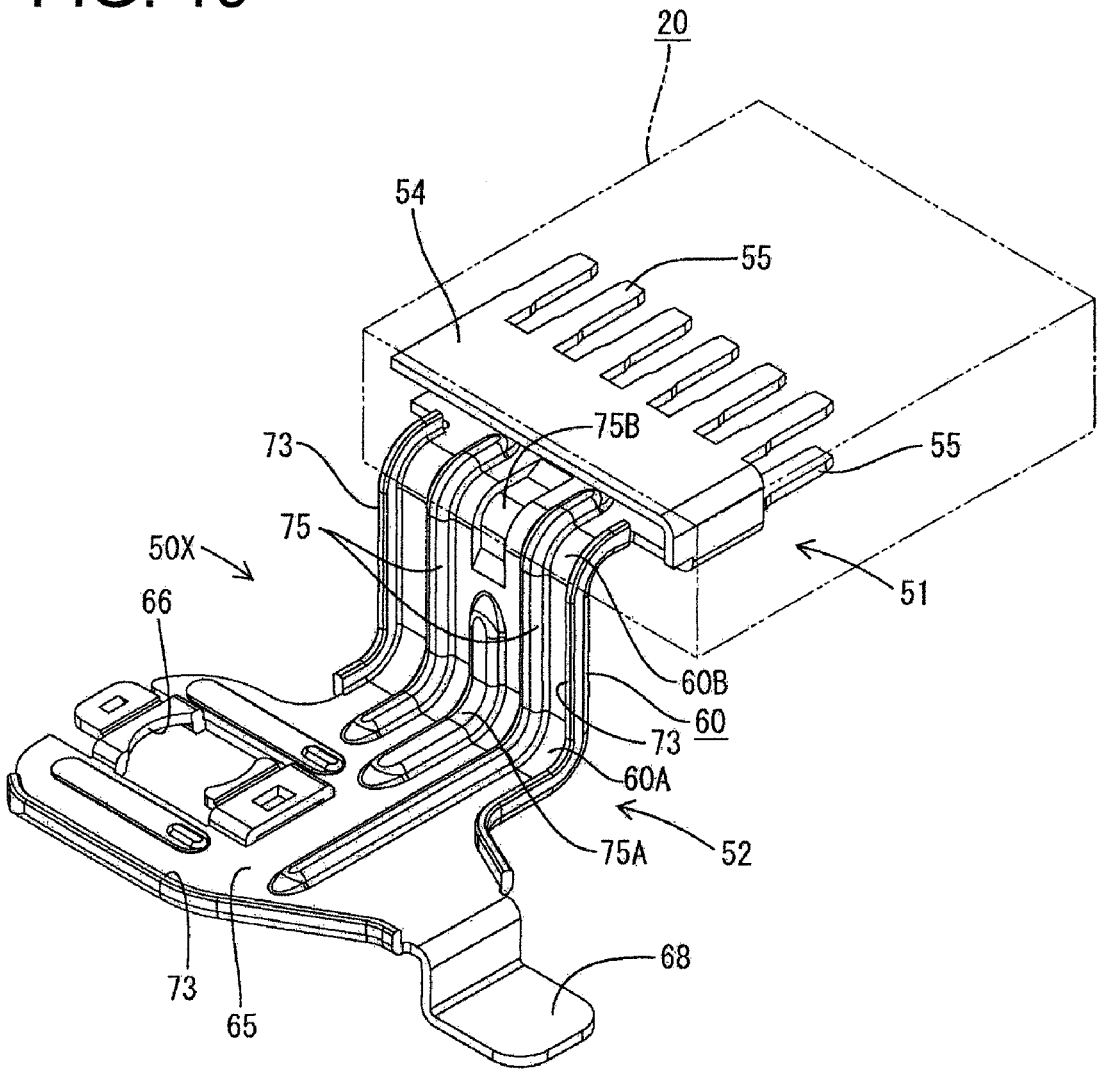
FIG. 19 is a perspective view of a joint terminal according to a second embodiment of the invention.
Figure 20:
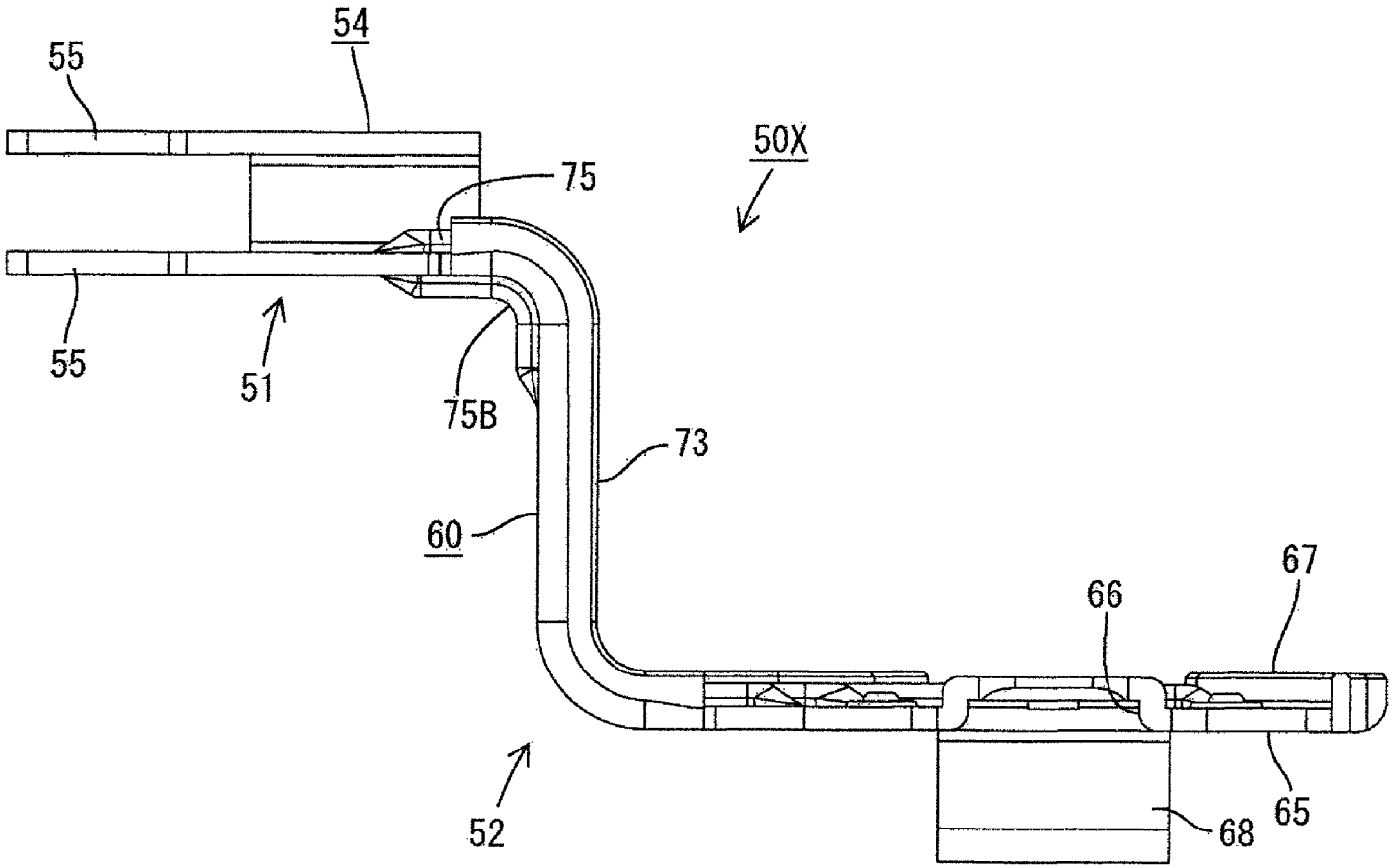
FIG. 20 is a side view of the joint terminal.

FIGS. 19 and 20 show a second embodiment of the invention.

In the first embodiment, the flanges 73 and the ribs 75 are provided to increase the strength of the joint between the base end of the leg 60 of the bracket 52 and the male terminal portion 51 in the joint terminal 50. The flanges 73 and the ribs 75 project from the top surface of the substantially horizontal surface 70 of the leg 60 facing the jig insertion grooves 30. Thus, if an attempt is made to form the reinforcing beads while avoiding the jig insertion grooves 30, the size of the ribs 75 such as the width is subject to restriction and may be disadvantageous in view of reinforcing the entire bracket 52.

In contrast, a joint terminal 50X of the second embodiment is similar to the first embodiment in that ribs 75 project toward a top side in a widthwise intermediate part of a bracket 52 at positions deviated from jig insertion grooves 30. However, the middle rib 75A of the three ribs 75 is formed only on a bend 60A between a vertical surface 71 of a leg 60 and a mounting portion 65. In other words, the rib 75A does not project up in an area extending from the bent portion 60B at an intermediate position of the leg 60 to the horizontal surface 70. Instead, another rib 75B is formed in this area to project down. Although not shown, a receiving portion is provided in the front surface of a housing 20 for receiving a fitted back end of the rib 75B on the underside.

The other structure is similar to or substantially the same as the first embodiment and members and parts having the similar or same functions as the first embodiment are identified by the same reference numerals and not described again.

If the rib projecting down is formed by hammering upon forming the rib on the horizontal surface 70 of the leg 60, the size is not subject to restriction since there is no likelihood that the rib interferes with the jig insertion grooves 30 at the underside. Thus, in this second embodiment, the rib 75B projecting down in the center position is wider than the rib 75A on the top side.

Bending stiffness of the bend 60B at the intermediate position of the leg 60 is increased. Further, the reinforcing beads are provided on both the top and the bottom. Thus, the bent portion 60B is strengthened against bending in both directions toward the top side and the underside.

The invention is not limited to the above described and illustrated embodiments. For example, the following embodiments are also included in the technical scope of the present invention.

Depending on conditions such as a surrounding space and the orientation of the connector in the case of fixing the joint connector to the grounding portion, it is also possible to withdraw the female terminals from the housing with the connector kept fixed to the grounding portion.

The position where the rib is formed to project toward the underside is not limited to the one illustrated above embodiment and may be appropriately selected.

The flanges may be formed by being bent down.

The invention is similarly applicable to a joint connector in which reinforcing beads of a bracket are not provided at a joint part between the base end of a leg portion and a male terminal portion.

Although the male terminals are arranged in two levels in the joint terminal in the above embodiment, they may be arranged only in one level or, conversely, arranged in three or more levels.

What is claimed is:

1. A joint connector (JC) for grounding, comprising:

a housing (20) having opposite front and rear ends and at least one cavity (21) penetrating the housing (20) from the front end to the rear end for receiving a female terminal (11) connected to an end of a wire (10);

at least one locking lance (22) in the cavity (21) for retaining the female terminal (11);

at least one jig insertion opening (30) in a front surface of the housing (20) for receiving a jig (80) to resiliently displace the locking lance (22) in an unlocking direction, and a joint terminal (50; 50X) mounted in the housing (20) and formed so that a bracket (52) to be mounted on a grounding portion is connected with a male terminal portion (51) having at least one male terminal (55) insertable into the cavity (21).

2. The joint connector of claim 1, wherein the at least one cavity (21) comprises a plurality of cavities (21), the cavities (21) being formed substantially side by side, and wherein the male terminal portion (51) comprises a plurality of substantially side by side male terminals (55) insertable into the respective cavities (21) from front.

3. The joint connector of claim 2, wherein the bracket (52) of the joint terminal (50; 50X) has at least one reinforcing bead (73; 75; 75B) at a position deviated from the jig insertion openings (30) when the joint terminal (50; 50X) is mounted in the housing (20).

4. The joint connector of claim 1, wherein:

a base end portion (70) of the bracket (52) is inserted and mounted into the front surface of the housing (20) with the jig insertion openings (30) located on a top side of the base end portion (70), and the at least one reinforcing bead (73; 75) is formed at a position deviated from the jig insertion opening(s) (30) on a top surface of the bracket (52).

5. The joint connector of claim 4, further comprising another reinforcing bead (75B) formed on an underside of the bracket (52) instead of a part of the reinforcing bead (75) formed on the top surface.

6. A wiring harness (WH), characterized by connecting a joint connector (JC) according to any one of the preceding claims to ends of a plurality of ground wires (10).

7. A joint connector (JC) for grounding, comprising:

a housing (20) having opposite front and rear ends and cavities (21) penetrating the housing (20) from the front end to the rear end, resiliently deflectable locking lances (22) projecting respectively into the cavities (21), jig insertion openings (30) extending into the front end of the housing (20) and aligned respectively with the locking lances (22);

female terminals (11) connected to ends of wires (10) and inserted respectively into the cavities (21) from the rear end of the housing (20) so that the respective wires (10) project out from the rear end of the housing (20), the female terminals (11) being engaged respectively by the locking lances (22); and a joint terminal (50; 50X) having a male terminal portion (51) mounted into the front end of the housing (20), the male terminal portion (51) having male terminals (55) inserted into the cavity (21) and connected respectively to the female terminals (11), a bracket (52) extending from the male terminal portion (51) and configured to be mounted on a grounding portion, at least one at least one reinforcing bead (73; 75; 75B) extending along the bracket (52) at a position deviated from the jig insertion openings (30) so that a jig (80) can be inserted through the jig insertion openings (30) and into the cavities (21) to resiliently displace the locking lances (22) in an unlocking direction.

8. The joint connector of claim 7, wherein the joint terminal (50; 50X) has opposite first and second surfaces, the first surface facing toward the jig insertion openings (30), portions of the reinforcing bead (73; 75; 75B) in proximity to the jig insertion openings (30) projecting from the second surface of the joint terminal (50; 50X).

* * * * *